US005232146A

United States Patent [19]

Antonacci

[11] Patent Number: 5,232,146

[45] Date of Patent: Aug. 3, 1993

[54] BOX AND BLANK THEREFOR

[76] Inventor: Tino Antonacci, 6705 Oshkosh, Chicago, Ill. 60631

[21] Appl. No.: 932,211

[22] Filed: Aug. 19, 1992

[51] Int. Cl.[5] ..... B65D 85/00

[52] U.S. Cl. ..... 229/8; 206/315.1; 229/932

[58] Field of Search ..... 229/8, DIG. 7; 206/315.1, 418, 423; 220/416

[56] References Cited

U.S. PATENT DOCUMENTS

| | | | |
|---|---|---|---|
| D. 128,625 | 8/1941 | Fischer . | |
| D. 283,600 | 4/1986 | Hammond . | |
| 1,176,932 | 3/1916 | Smith . | |
| 1,861,206 | 5/1932 | Burgess | 229/8 |
| 2,345,646 | 4/1944 | Williamson . | |
| 2,486,045 | 10/1949 | Madden, III . | |
| 3,750,934 | 8/1973 | Clinage | 206/418 |
| 4,059,221 | 11/1977 | Olson . | |
| 4,087,041 | 5/1978 | Centanni | 220/416 |
| 4,372,477 | 2/1983 | Wytko | 220/416 |
| 4,406,380 | 9/1983 | Paige | 220/416 |
| 4,445,613 | 5/1984 | Cassidy | 206/418 |
| 4,457,431 | 7/1984 | Lundquist . | |
| 4,778,392 | 10/1988 | Mitchell . | |
| 4,856,706 | 8/1989 | Van Der Straten | 229/8 |
| 4,899,884 | 2/1990 | Madsen . | |

FOREIGN PATENT DOCUMENTS

| | | | |
|---|---|---|---|
| 27350 | 4/1981 | European Pat. Off. | 229/8 |
| 2241892 | 5/1973 | Fed. Rep. of Germany | 229/8 |

*Primary Examiner*—Gary E. Elkins

*Attorney, Agent, or Firm*—Patnaude, Videbeck & Marsh

[57] ABSTRACT

A blank is provided having a first plurality of rectangular sections in side-by-side relationship separated by creases. A plurality of trapezoidal sections are positioned with one trapezoidal section positioned with the long parallel end of one trapezoidal section adjacent the end of each of the first rectangular sections, and a second plurality of rectangular sections is positioned with one end of each of the second rectangular sections adjacent the short parallel end of the trapezoidal sections. The outer two edges of the outer first rectangular sections are attachable to each other to form a first box section, and a strap is provided to surround the second plurality of rectangular sections to form a second box section. When assembled, the plurality of trapezoidal sections forms a tapered portion between the first box section and the second box section. When suitable dimensions are chosen for the sides and edges of the various rectangular sections and the trapezoidal sections, the box when assembled will have the appearance of a baseball bat.

11 Claims, 2 Drawing Sheets

BOX AND BLANK THEREFOR

The present invention relates to a box which may be used to contain certain products and which has a distinctive shape, and in particular a box and the blank therefor which when the portions thereof are suitably dimensioned, has the exterior appearance of a baseball bat.

BACKGROUND OF THE INVENTION

It is frequently desirable to market products in containers which enhance the marketability of the products contained therein. Although it is desirable for products to be marketable as a result of their desirable qualities, in some cases, consumers will acquire products, at least partly because of the container in which they are marketed.

Ice cream cones are marketed in containers wherein the cones are nested one within another and a nested stack of 24 ice cream cones assembled into a generally cylindrical shape with the outer perimeter of the cylinder defined by the mouths of the respective nested cones, with the outer cones's conical section extending from one end of the cylinder. Traditionally, ice cream cones are marketed in containers which are adapted to contain one or more stacks of cones therein, and have generally rectangular sides.

Prior art configurations of containers for ice cream cones do not enhance the marketability of the products they contain. When ice cream cones are marketed in the proximity of baseball parks or in ice cream establishments with the motif of a baseball park, for example, it is desirable to provide a container for the ice cream cones which would be suggestive of the baseball motif such as a container in the shape of a baseball bat.

BRIEF DESCRIPTION OF THE INVENTION

Briefly, the present invention is embodied in a blank which can be assembled into a box, suitable for containing a product, such as a plurality of ice cream cones, and has a distinctive exterior shape.

The blank has a plurality of first rectangular sections, and each of the first rectangular sections has first and second parallel end edges, and the sides of the first rectangular sections are all of equal length and are positioned in side-by-side relationship separated by creases. An appropriate means is provided to attach the outer sides of the outer rectangular sections to each other to define the side members of a first box member.

A plurality of trapezoidal sections, each of which has a short and a long parallel end are positioned with the long parallel end of one trapezoidal section adjacent the first end edge edge of each of the first rectangular sections. A plurality of second rectangular sections each having first and second parallel end edges are disposed with the first end of one of the second rectangular sections adjacent to the short parallel side of each trapezoidal section. A strap of pliable material is adapted to surround the second rectangular sections to retain the second rectangular section to define the sides of a second box section when the outer sides of the outer of the first rectangular sections are joined together.

An additional feature of the present invention is a plurality of second trapezoidal sections having short and long parallel sides and disposed such that the short parallel side of one of the second trapezoidal sections is adjacent the second end edge of each of the second rectangular sections.

A further feature of the present invention is the provision of a plurality of third rectangular sections having first and second end edges and parallel sides disposed in attached side-by-side relationship to each other, separated by creases and the first parallel end of one of the third rectangular section is disposed adjacent each of the long parallel sides of the second trapezoidal sections. An appropriate means is provided to attach the outer sides of the outer two of the third rectangular sections to each other to define the sides of a third box section.

When assembled as described, the blank forms an elongate box, which resembles a baseball bat when suitable dimensions are chosen for the sides of the various rectangular sections.

GENERAL DESCRIPTION OF THE DRAWINGS

The present invention will be better understood by a reading of the following detailed description taken in connection with the accompanying drawings wherein.

DETAILED DESCRIPTION OF A PREFERRED EMBODIMENT

Figure 1:
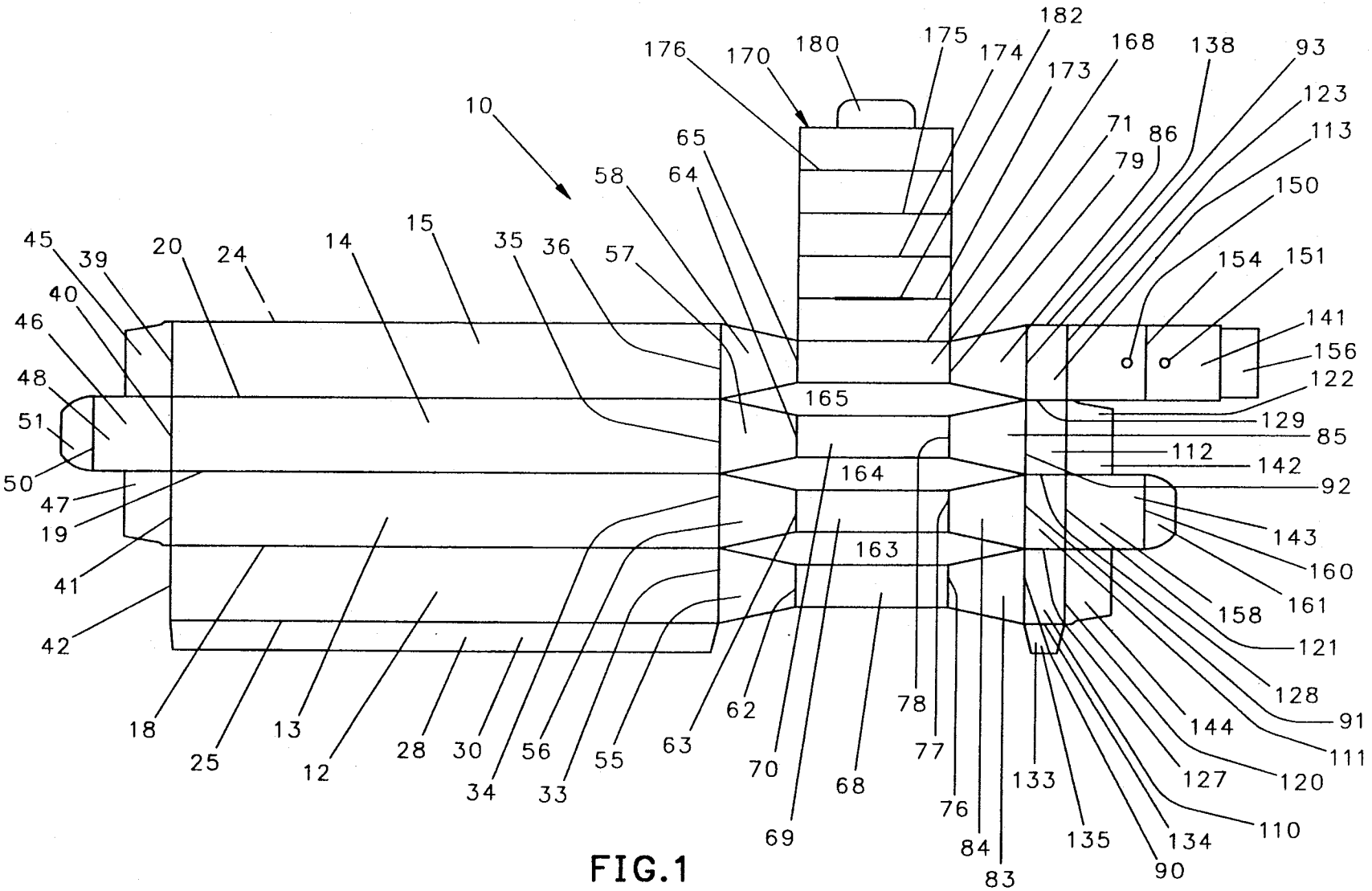
FIG. 1 is a plan view of a blank suitable for assembly into a box in accordance with the present invention.
Figure 2:
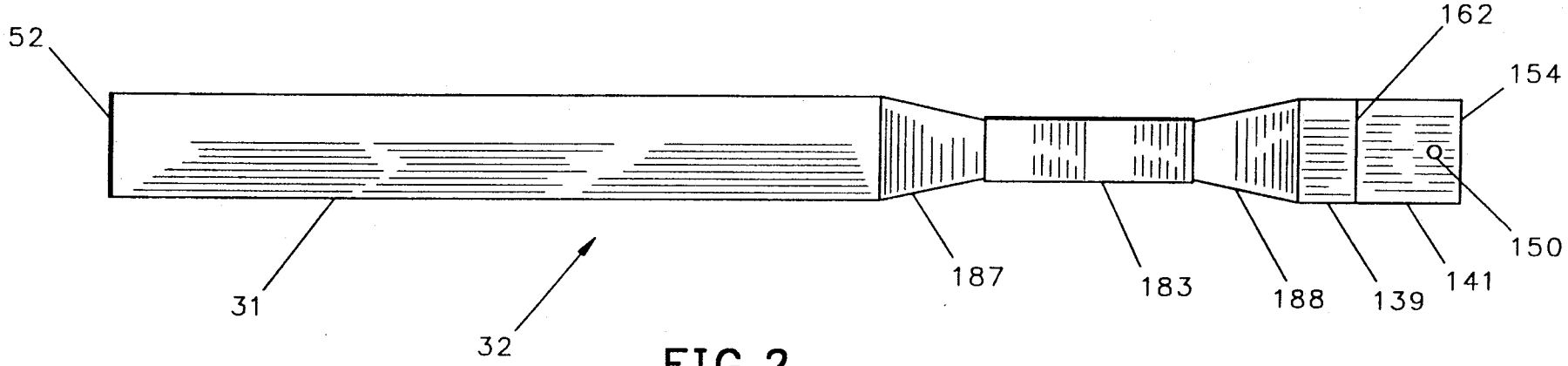
FIG. 2 is a front elevational view of a box assembled from the blank shown in FIG. 1.
Figure 3:
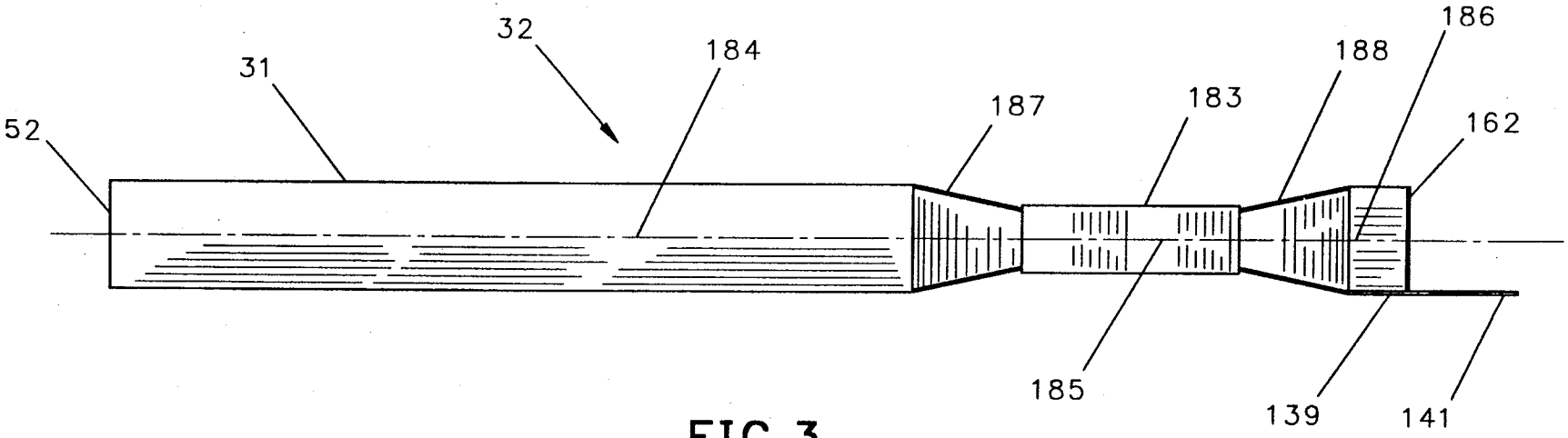
FIG. 3 is a side elevational view of a box assembled from the blank shown in FIG. 1.

Referring to FIG. 1, a blank 10 has four first rectangular sections 12, 13, 14, 15. The first rectangular sections are in side-by-side relationship joined at their long sides and separated by creases 18, 19, 20 which defines the common sides of the first rectangular sections 12, 13, 14, 15. The two outer rectangular sections, 12, 15 have outer side edges 24, 25, respectively, of which outer side edge 24 is an edge of the blank 10 and outer side edge 25 is a crease. Adjacent the crease 25 is a rectangular strip portion 28 covered with an adhesive material 30 which is adapted to be attached to the outer side edge 24 such that rectangular sections 12, 13, 14, 15 define the sides of a first box section 31 of box 32 as shown in FIG. 2 and FIG. 3.

The rectangular sections 12, 13, 14, 15 each have respective first parallel end edges 33, 34, 35, 36 and second parallel end edges 39, 40, 41, 42. Second parallel end edge 42 is the edge of the blank 10, whereas second parallel ends 39, 40, 41 are creases adjacent to which are tabs 45, 46, 47. In the preferred embodiment, the first rectangular section 12, 13, 14, 15 are all of equal width such that the cross-section of the assembled first box section 31 is a square. Accordingly, tab 46 has a square section 48 with sides equal to the length of the second parallel end edges 39, 40, 4, 42 of the first rectangular sections 12, 13, 14, 15, and outwardly of the square section 48 and defined by a crease 50, a tongue section 51. Tabs 45, 47 have trapezoidal shapes which are smaller than the square section 48 of tab 40 such that when the blank 10 is folded along the creases 18, 19, 20 and the adhesive material 30 on the strip 28 secured to the outer edge 24, then tabs 45 and 47 may be folded inwardly and thereafter tab 46 folded over tabs 45 and 47 and tongue section 51 inserted within the box 32 adjacent second parallel end 42 to form the bottom 52 as shown in FIG. 2 and FIG. 3.

The first parallel end edges 33, 34, 35, 36 of the first rectangular sections 12, 13, 14, 15 are creases and adjacent to the first parallel end edges 33, 34, 35, 36 are a plurality of first trapezoidal sections 55, 56, 57, 58. The first trapezoidal sections 55, 56, 57, 58 have long parallel end edges which are defined by the creases 33, 34, 35, 36 which also define the first parallel end edge of the first rectangular sections 12, 13, 14, 15. The first trapezoidal sections also have short parallel end edge defined by creases 62, 63, 64, 65.

Adjacent each of the short parallel end edges 62, 63, 64, 65 of the first trapezoidal sections 55, 56, 57, 58 are a plurality of second rectangular sections 68, 69, 70, 71. A first end edge of each of the second rectangular sections 68, 69, 70, 71 are defined by the crease 62, 63, 64, 65 which also define of the short parallel end edges of the first trapezoidal sections 55, 56, 57, 58. The sides of the second rectangular sections 68, 69, 70, 71 are spaced and parallel to each other. The second end edges of the second rectangular sections 68, 69, 70, 71 are defined by creases 76, 77, 78, 79 which also define the short parallel end edges of a plurality of second trapezoidal sections 83, 84, 85, 86. The long parallel end edge of the second trapezoidal sections 83, 84, 85, 86 are defined by creases 90, 91, 92, 93.

Adjacent the long parallel end edges formed by creases 90, 91, 92, 93 of the second trapezoidal sections 83, 84, 85, 86 are a plurality of third rectangular sections 110, 111, 112, 113. The third rectangular sections 110, 111, 112, 113 are defined at one end by the creases 90, 91, 92, 93, and on the opposite end by creases 120, 121, 122, 123. Like the first rectangular sections 12, 13, 14, 15 the third rectangular sections 110, 111, 112, 113 are in side by side relationship separated by creases 127, 128, 129. A tab portion 133 adjacent the outer edge 134 of outer rectangular section 113 is provided with adhesive material 135 and adapted to be secured to the outer edge 138 of the outer third rectangular section 110 and form a third box section 139 when the blank is folded along creases 127, 128, 129 and the first box section 31 is assembled with the adhesive strip 28 secured to the outer edge 24 of the first rectangular section 12 as described above.

There is also provided tabs 141, 142, 143, 144 disposed adjacent the second end edges 120, 121, 122, 123 of the third rectangular sections 110, 111, 112, 113. Tab 141 has an extended length and is provided with holes 150, 151 therein and midway between holes 150, 151, a transverse crease 154, such that when the tab 141 is folded on the crease 154, hole 150 will be superimposed over hole 151 and provide a means for suspending the box formed by assembling the blank 10 as described herein. The width of the distal end edge 156 of tab 141 is less than the length of crease 120.

Tab 143 has a square section 158 with sides equal to the widths of the third rectangular sections 110, 111, 112, 113 and separated by a crease 160, is a tongue 161 at the distal end of tab 143. Tabs 142 and 144 are trapezoidal in shape and sized somewhat smaller than square section 158. When the first and third box sections 31, 139 are assembled with the adhesive portions 28, 133 to secured to the respective outer edges of the first and third rectangular sections 12 and 110 respectively, tab sections 142 and 144 can be folded inwardly and the square section 158 of tab 143 may be folded thereover with tongue 161 inserted into the open end of the box 32 and thereby form the second end 162 as shown in FIG. 2 and FIG. 3.

As can be seen from FIG. 1, the first trapezoidal sections 55, 56, 57, 58 have non-parallel sides which converge from the ends of the long parallel sides 33, 34, 35, 36 towards the short parallel sides 62, 63, 64, 65, and therefore the ends of the short parallel sides 62, 63, 64, 65 are spaced apart from one another. Similarly, the sides of each of the second rectangular sections 68, 69, 70, 71 are parallel to the sides of adjacent ones of the second rectangular sections, but spaced therefrom. The short parallel end edges 76, 77, 78, 79 of the second trapezoidal sections 83, 84, 85, 86, which adjoin the second end edges of the second rectangular sections 68, 69, 70, 71 are similarly spaced and the non-parallel sides of the second trapezoidal sections 83, 84, 85, 86 diverge and intersect with the diverging sides of adjacent trapezoidal sections at the long parallel ends 90, 91, 92, 93. As a result of the foregoing, portions of the blank 10 are removed to create holes 163, 164, 165.

The blank further provides, adjacent the outermost side edge 168 of the second rectangular section bearing indicia number 71, a generally rectangular strap 170 having a plurality of parallel equally spaced creases 168, 173, 174, 175, 176, and at the distal end of the rectangular strap 170, a tab 180. A slot 182 having a length equal to the width of the tab 180 is provided in crease 173. The length of the strap 170 and the spacing of the creases 168, 173, 174, 175, 176 are such that when the blank 10 is folded at the creases 18, 19, 20 and 127, 128, 129 and the adhesive portions 28 and 133 secured to form first and third box sections 31, 139 the creases at the ends of the first and second trapezoidal sections 55, 56, 57, 58, 83, 84, 85, 86 can be folded and bent such that the sides of adjacent ones of the second rectangular sections 68, 69, 70, 71, are brought inwardly into mutual contact along their length, or into the immediate proximity of one another. The strap 170 may then be wrapped around the outer surfaces of the second rectangular sections 68, 69, 70, 71 and the tab 180 inserted in the slot 182 to retain the second rectangular sections 68, 69, 70, 71 and define a second box section 183.

In the preferred embodiment, the principal longitudinal axis 184 of the first box section 31 is co-axial with the principal longitudinal axis 185 of the second box sections 183, and is also co-axial with the principal longitudinal axis 186 of the third box section 139. The first trapezoidal sections 55, 56, 57, 58 and the second trapezoidal sections 83, 84, 85, 86 then form first and second tapered sections 187 and 188, respectively. As a result of the foregoing the completed box, 32, when the sides of the various rectangular sections and trapezoidal sections are suitably dimensioned, will have the exterior appearance of a baseball bat. The box 32 can retain 24 ice cream cones, and can be displayed by suspending the box 32 from a hook or string passed through holes 150, 151. There is therefore disclosed a blank 10 which when folded and assembled in a box 32 presents the exterior appearance of a baseball bat. Ice cream cones may be inserted into the box 32 with the tapered end of the outer cone extending toward the second box section 183 and into first tapered section 187.

While the present invention has been described in connection with one embodiment, it will be apparent to those skilled in the art that many modifications and changes thereto may be made without departing from the true spirit and scope of the invention. Therefore, it is intended by the appended claims to cover all such changes and modifications which come within the true spirit and scope of the invention.

What is claimed:

1. A panel of foldable material comprising in combination:

a plurality of first rectangular sections, each of said first rectangular sections having first and second parallel and edges, and each of said first rectangular sections having parallel sides, said first rectangular sections disposed in attached side by side relationship with two outer of said first rectangular sections and at least one inner of said first rectangular section and a crease between adjacent pairs of said sides of said first rectangular sections, each of said two outer of said first rectangular sections having an outer side, means for joining together said outer sides of said two outer of said first rectangular sections to that when said outer sides of said two outer of said first rectangular sections are joined, said first rectangular section will form sides of a first box section, a plurality of first trapezoidal sections, each of said first trapezoidal sections having a long end edge and a short end edge, and said long end edge of each of said first trapezoidal being parallel to said short end edge thereof, said plurality of first trapezoidal sections disposed with each of the said parallel end edges of said first trapezoidal section adjoining one of said first end edges of one of said first rectangular sections, a plurality of second rectangular sections, each of said second rectangular sections having first and second parallel end edges and each of said second rectangular sections having parallel sides, said second rectangular sections being disposed with said sides of all of said second rectangular sections being mutually parallel, and said plurality of second rectangular sections being disposed with each of said short end edges of each of said first trapezoidal sections adjoining one of said end edges of one of said second rectangular sections.

2. A panel of foldable material in accordance with claim 1 wherein said first end edges of said first rectangular sections are coplanar when said panel is folded along said creases between adjacent pairs of said sides of said first rectangular sections.

3. A panel of foldable material in accordance with claim 1 wherein said panel is foldable along said creases to form first and second box sections respectively and each of said first and said second box sections have a principal longitudinal axis and said principal longitudinal axis of said first box section is co-axial with said principal longitudinal axis of said second box section.

4. A panel of foldable material in accordance with claim 1 wherein all said sides of said first rectangular sections are of equal length, and all of said sides of said second rectangular sections are of equal length.

5. A panel of foldable material in accordance with claim 1 further comprising a strap adjoining one of said sides of one of said second rectangular sections.

6. A panel of foldable material in accordance with claim 1 further comprising:

a plurality of second trapezoidal sections, each of said second trapezoidal sections having a long end edge and a short end edge, and said long end edge of each of said first trapezoidal section being parallel to said short end edge thereof, said plurality of second trapezoidal sections disposed with each short end edges adjoining one of said second end edges of said second rectangular sections, a plurality of third rectangular sections, each of said third rectangular sections having first and second parallel end edges and each of said third rectangular sections having parallel sides, said third rectangular sections disposed in attached side by side relationship with two outer of said third rectangular sections, and at least one inner of said third rectangular sections and a crease between adjacent pairs of said sides of said third rectangular sections, and each of said two outer of said third rectangular section shaving an outer side, means for joining together said outer sides of said two outer of said third rectangular sections so that when said outer sides of said two outer of said third rectangular sections are joined, said third rectangular sections will form sides of a third box section, said plurality of third rectangular sections being disposed with one of said end edges of each of said third rectangular sections adjoining each of said long end edges of said second trapezoidal sections.

7. A panel of foldable material in accordance with claim 6 wherein all said sides of said first rectangular sections are of equal length, and all of said sides of said second rectangular sections are of equal length.

8. A panel of foldable material in accordance with claim 6 further comprising a strap adjoining one of said sides of said second rectangular sections.

9. A panel of foldable material in accordance with claim 6 wherein said panel is foldable along said creases to form first, second, and third box sections, respectively, and each of said first, second, and third box sections have a principal longitudinal axis and said principal longitudinal axes of said first, second and third box sections are all co-axial.

10. A box comprising in combination a first box section having a plurality of rectangular side sections, and having a principal longitudinal axis, each of said side sections of said first box section having a width, a second box section spaced from said first box section, said second box section having a plurality of rectangular side sections equal in number to said plurality of first box sections, and having a principal longitudinal axis coaxial with said principal longitudinal axis of said first box section, said rectangular side sections of said second box section having a width which is less than the width of an adjacent side section of said first box section, and a first tapered section extending between said first box section and said second box section.

11. A box in accordance with claim 10 further comprising, a third box section spaced from said second box section, said third box section having a plurality of rectangular side sections equal in number to said plurality of first box sections, and having a principal longitudinal axis co-axial with said principal longitudinal axis of said first and said second box sections, said rectangular side sections of said third box sections having a width which is greater than the width of an adjacent side section of said second box section, and a second tapered section extending between said second box section of said third box section.

* * * * *

UNITED STATES PATENT AND TRADEMARK OFFICE

CERTIFICATE OF CORRECTION

PATENT NO. : 5,232,146

DATED : August 3, 1993

INVENTOR(S) : Tino Antonacci

It is certified that error appears in the above-identified patent and that said Letters Patent is hereby corrected as shown below:

In column 5, line 6, after "parallel" delete "and" and substitute -- end --.

In column 5, line 17, after "sections" delete "to" and substitute -- so --.

Signed and Sealed this

Twenty-ninth Day of March, 1994

Bruce Lehman

*Attest:*

BRUCE LEHMAN

*Attesting Officer*

*Commissioner of Patents and Trademarks*